United States Patent [19]

Tolsma

[11] 4,187,651

[45] Feb. 12, 1980

[54] METHOD FOR MANUFACTURING THERMALLY INSULATED BUILDINGS, CONSTRUCTION ELEMENTS SUITABLE FOR APPLICATION IN THIS METHOD AND A METHOD OF MANUFACTURING THE BUILDING CONSTRUCTION ELEMENTS

[76] Inventor: Auke Tolsma, Polarisstraat 48, Emmeloord, Netherlands

[21] Appl. No.: 814,925

[22] Filed: Jul. 12, 1977

[30] Foreign Application Priority Data

Jul. 15, 1976 [NL] Netherlands ..... 7607840

[51] Int. Cl.[2] ..... E04C 3/02

[52] U.S. Cl. ..... 52/79.1; 52/93; 52/309.4; 52/612; 264/46.5; 264/46.6; 428/71; 428/310

[58] Field of Search ..... 52/90–94, 52/259, 262, 417, 612, 596, 79.1, 309.4; 264/46.5, 46.6; 428/170, 218, 71, 310, 313; 59/93

[56] References Cited

U.S. PATENT DOCUMENTS

| | | | |
|---|---|---|---|
| 2,642,920 | 6/1953 | Simone et al. | 264/46.5 |
| 3,014,611 | 12/1961 | Marshall | 52/262 |
| 3,091,946 | 1/1963 | Kesling | 264/46.8 |
| 3,152,199 | 10/1964 | Roberts | 264/46.5 |
| 3,184,012 | 5/1965 | Fujishima et al. | 52/90 |
| 3,200,026 | 8/1965 | Brown | 264/46.5 |
| 3,229,441 | 1/1966 | Heffner | 264/46.6 |
| 3,462,341 | 8/1969 | Littin | 52/596 |

FOREIGN PATENT DOCUMENTS

| | | | |
|---|---|---|---|
| 563849 | 9/1958 | Canada | 52/90 |
| 782194 | 4/1968 | Canada | 52/90 |
| 937613 | 1/1956 | Fed. Rep. of Germany | 52/90 |

*Primary Examiner*—James L. Ridgill, Jr.
*Attorney, Agent, or Firm*—Kenyon & Kenyon

[57] ABSTRACT

A method and building construction element for manufacturing thermally insulated buildings, in which building construction elements are applied which have the form of half a truss with an outer arch side, an inner arch side and two sides of shape plate truss, comprising a core of synthetic hard foam of which the outer arch side and the inner arch side are provided with plate-like coverings and of which sides are uncovered, which half trusses are combined at the construction site to form complete trusses, arranged in adjacent relationship, whereafter the adjoining surfaces are sealingly interconnected. In the method for manufacturing the building construction elements, a mold of corresponding shape is provided comprising an open side and arranged with the open side up, while the upright bent walls of the mold are provided on the inside with a plate-like lining, whereafter the mold is supplied through the open side with the foaming reaction mixture.

7 Claims, 5 Drawing Figures

20
17
18
16
19
15
14
25
3
28
26
18
21
2
31
30
22
27
24
18'

METHOD FOR MANUFACTURING THERMALLY INSULATED BUILDINGS, CONSTRUCTION ELEMENTS SUITABLE FOR APPLICATION IN THIS METHOD AND A METHOD OF MANUFACTURING THE BUILDING CONSTRUCTION ELEMENTS

The present invention relates to a method of manufacturing thermally insulated buildings, in which in one stage the supporting construction is built up and in a further stage the thermal insulation is applied and to prefabricated construction elements for thermally insulated buildings.

It is conventional when building thermally insulated buildings, to first finish the building in more or less ready form by means of building construction elements designed as supporting construction elements, and then subsequently insulating same in a separate stage of the building phase by means of elements that are specifically designed for insulating purposes, e.g. sandwhich panels composed of a hard foam layer which is lined on one or both sides usually with metal sheets. Also known is the technique in which the insulation is not installed by using readymade insulation elements but by preparing the insulating foam in situ e.g by introducing the respective reaction mixture into a cavity in a foaming condition.

In the prior art methods it is necessary to interconnect the supporting construction and the insulation elements for attachment purposes. However, often the connection places are heat or cold bridges, so that undesirable heat exchange occurs along said route.

It is the object of the invention, therefore, to provide a method of building thermally insulated buildings, in particular of sheds for the storage therein of perishable goods under conditioned circumstances, especially as regards the temperature, for instance agricultural products, without having to connect thermally insulating elements to the supporting construction.

The above object is achieved in that according to the invention the stage of building up the supporting construction and the stage of the application of the thermal insulation are combined.

More in particular according to the present invention, building construction elements are employed which have both a supporting and a thermally insulating function. According to the method of the invention use is made of building construction elements having the shape in side view of half a truss of the plate truss type each construction element, having an outer arch side, an inner arch side and two lateral edges in a form known per se, in which method complete trusses are assembled from such building construction elements on the building site and arranged in side-by-side relationship, whereafter the adjacent surfaces are sealingly interconnected.

The invention also relates to a building construction element suitable for application in the above-described method, in which the element has the shape in side view of half a truss of the plate truss type, having an outer arch side, an inner arch side and two lateral sides and characterized in that the element comprises a core of synthetic hard foam of which the outer arch side and the inner arch side are covered with plate-like linings adhering to the foam material and the lateral sides of which are unlined.

Partly because of the very high chemical stability thereof, it is preferred that the core of synthetic hard foam is made of a polyurethane hard foam material, while for reasons of building conditions, it is preferred to employ a reaction mixture for making the polyurethane hard foam which, in case of free foaming, leads to a foam product having a weight per unit volume of about 30 kg/m$^3$. In this connection it should be observed furthermore that, although it is naturally highly important according to the invention that buildings are obtained having a proper thermal insulation, the standard in designing the building construction elements is in the first place the strength and not the insulation. Furthermore the major advantage of the invention is that in case a building construction element designed for the proper strength has locally insufficient insulation properties, said element can be made slightly thicker in said place, which will then result in that the element becomes stronger in that place.

Variations in strength of the elements according to the invention may be achieved by two ways, viz. (a) variation in thickness of the core of synthetic hard foam and (b) variation in the weight per unit volume of the foam product, in which respect a greater weight per unit volume means a stronger product.

As is well-known, the angular region of plate type trusses, that is the region wherein the truss parts are at an angle to each other, is critically loaded, which is the reason why in addition to the larger material thickness to be maintained normally in this region, it is preferred with the building construction elements according to the invention that in the angular region of the element, the weight per unit volume of the core of synthetic hard foam is also largest. In particular, it is recommended that in a substantial portion of the element the weight per unit volume of the synthetic hard foam be about 40 kg/m$^3$ on an average and in the angular area on an average about 2–3 kg/m$^3$ more. Thus it is possible to construct building construction elements by means of which a column-less span of 24–26 m or even larger is possible. It is advantageous from a construction viewpoint that the width of the element is substantially equally large in all places and at least for the major portion of the element that the width is larger than the thickness.

Irrespective of the control of the strength of the building construction elements according to the invention by regulating the strength of the core of synthetic hard foam on the basis of the two above-described possibilities, also the choice of the materials and the shaping of the linings employed for the elements plays a role. If therefore a metal lining plate, for instance of steel, is chosen having the form of a corrugated sheet or having a sheet piling profile, there is obtained a stronger element at an equal weight per unit volume of the core of synthetic hard foam. In view of the above it is preferred that at least a part of the element, at the outer arch side parallel to the main direction, is provided with a lining having a sheet piling profile.

In connection with the standard dimensions of commercially available plate materials to be considered for application as a lining for the elements according to the invention, the building construction elements according to the invention should preferably have a width of 95–105 cm.

The invention furthermore relates to a method of manufacturing the above-described building construction elements according to the invention, which method is characterized in that a mold of corresponding shape and having an open side is arranged with the open side up the upright bent walls of the mold are provided on the inside with a plate-like lining, whereafter the mould is supplied via the open side with the foaming reaction mixture.

With an eventual width of the building construction element of 100 cm and accordingly an approximately equal height of the mold, it is possible, to add the total required quantity of foaming reaction mixture at one time to the mold, but difficulties will occur during foaming. For obtaining a proper foam product it is not recommended to introduce more reaction mixture at one time into the mold than corresponds to a foaming height of 50–60 cm. In general, therefore, depending on the required width of the element the foaming reaction mixture will be introduced into, the mold in one or more stages and after each addition the material is allowed to foam. The adjustment of the weight per unit volume to the required value can be achieved during the foaming process by covering the foaming material in the mold, so that the mixture, is allowed to foam under pressure.

For obtaining the surprising strength of the construction elements according to the invention, it is essential that the lining plates to be applied to the core in the mold have a good bonding relative to the synthetic hard foam, and the choice of the type of lining material to be applied will therefore depend in the first place on the bonding properties. For instance in combination with a synthetic hard foam of polyurethane lining plates of wood and tin-coated or zinc-coated plate iron may be suitably employed. The thickness of the lining plates is not restricted to critical limits. Suitable thickness dimensions for the plate iron are for instance about 0.75 mm and for the plate of wood for instance 4–6 mm.

BRIEF DESCRIPTION OF THE DRAWINGS

One embodiment of the invention will now be described, by way of example, with reference to the accompanying drawings wherein.

DETAILED DESCRIPTION OF THE PREFERRED EMBODIMENT

Figure 1:
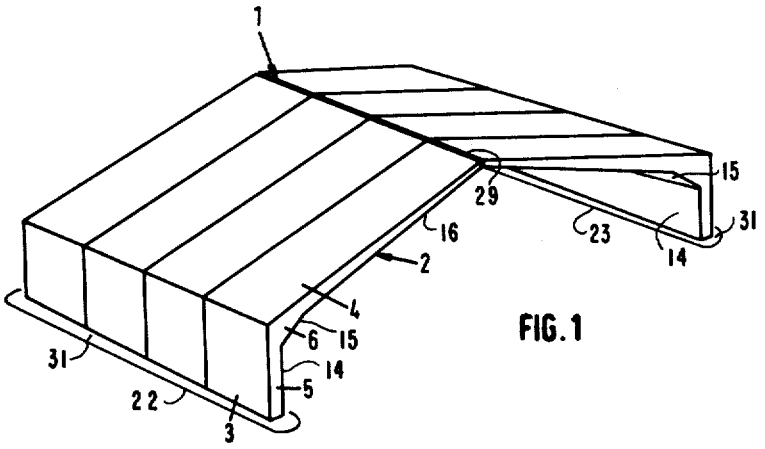
FIG. 1 is a perspective top view of a skeleton building composed of a plurality of building construction elements according to the invention.

In FIG. 1 a truss type building 1 is assembled from eight building construction elements 2 pair-wise coupled to form complete building trusses according to the invention.

Figures 3, 4, 5:
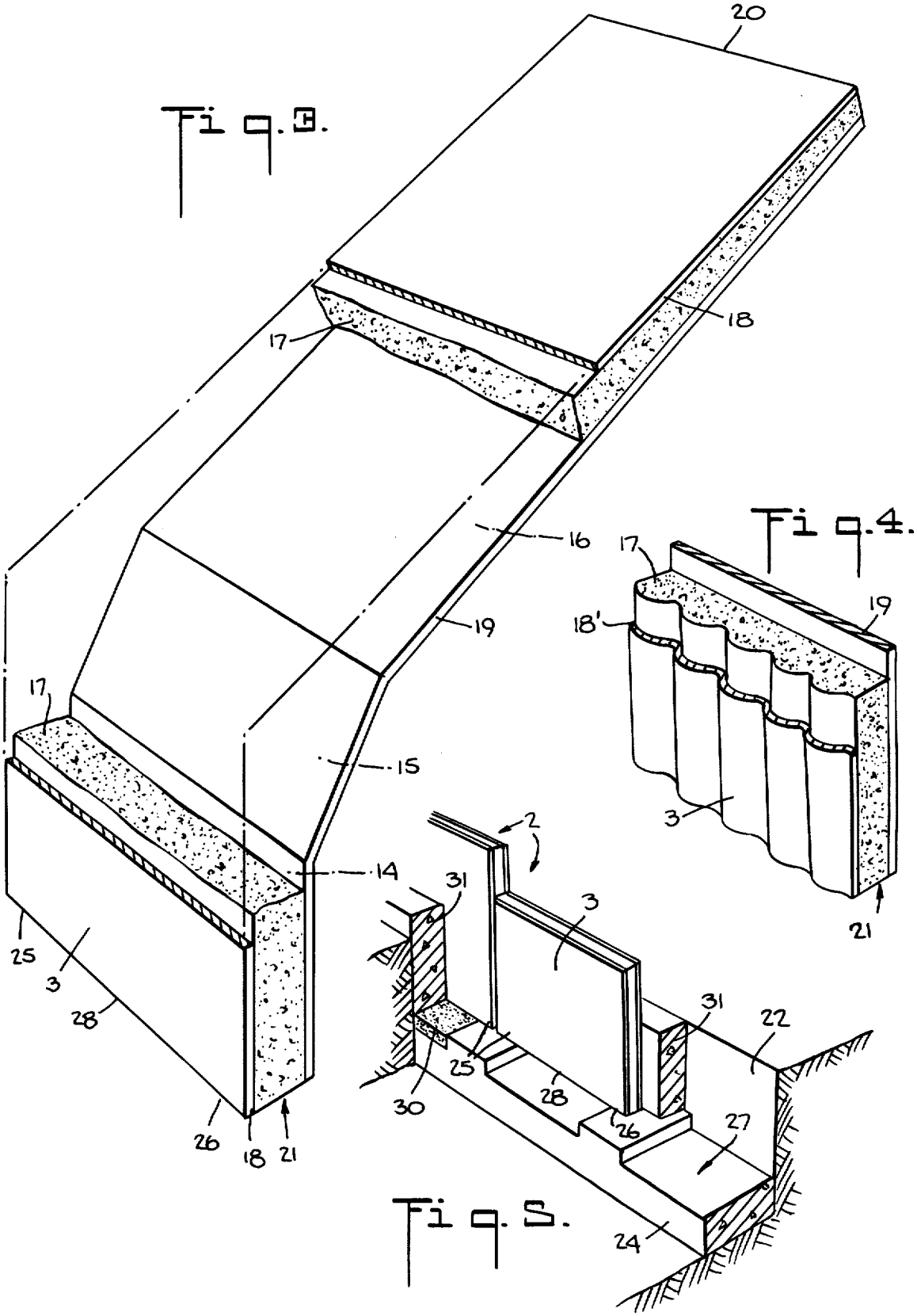
FIG. 3 is a perspective view of one embodiment of a building construction element according to the invention.
FIG. 4 is a perspective view of the base portion of an alternative embodiment of a building construction element according to the invention.
FIG. 5 is a perspective view, partially cut away, of a portion of a partly erected building according to the method of the invention.

Each element 2 comprises an outer arch side having an outer wall face 3 and a roof face 4, a corresponding inner arch side having an inner wall face 14, a bevelled angle face 15, and a ceiling face 16, and two lateral sides 5, of which only one is shown in FIG. 1. The angular area 6 is where, as mentioned above, the load of the element is most critical. Therefore it is recommended to choose a bevelled configuration for the inner bend in the angular area 6, as shown, or a round configuration. As depicted in FIGS. 3 and 4, each element 2 comprises a core 17; the outer arch side of the core is lined on faces 3 and 4 wood panels or plate iron 18 (FIG. 3) or with corrugated steel or sheet piling 18' (FIG. 4), and the inner arch side of the core is lined on faces 14, 15, and 16 with a wood panel or plate iron lining 19; the lateral sides 5 and the ridge pieces 20 and bases 21 are unlined. The height of the side face 3 may for instance be 5 m, of which to a height of about 80 cm is below ground level resting on a foundation.

With smaller spans it may be advantageous to combine the building construction elements in the factory to complete building trusses and thereafter transporting the assembly to the building site. With spans of for instance about 24 m, this method is not possible, however, an account of transport problems, and the entire assembly should be performed on the building site. The assembly is performed as follows.

With reference to FIGS. 1 and 5, two trenches 22 and 23 are excavated in the soil in spaced apart relationship, corresponding to the span of the completed trusses. In the trenches there are subsequently poured supporting beams 24 of for instance concrete serving as foundation. The depth of the trenches is such that the distance from the top of the supporting beams to the ground level is about 80 cm. A building construction element 2 is positioned with the base 21 on a supporting beam. Care is taken that in the first place only the end parts 25, 26 of the base of an element rests on the supporting beam, for instance by profiling the top face of the supporting beam accordingly so that a space 27 is provided underneath the central portion 28 of the base between the base and the supporting beam. Subsequently the second element which has to form a complete building truss with the first, is positioned in the other trench. At the location 29 between the ridge pieces 20 the two elements are then indissolubly foamed together by applying the reaction mixture used for the hard foam core. Subsequently the second pair of elements is arranged and assembled to form a truss, whereafter both trusses are foamed together at their adjacent lateral sides 5 by applying the above-mentioned reaction mixture, This procedure is repeated for the rest of the building elements.

When thus the skeleton building is ready, the free spaces underneath the bases are filled with foam 30 and the trenches are filled with concrete 31. Thereafter the finishing operations can be initiated, such as the installation of the end walls, possible windows, and so forth (not shown).

Figure 2:
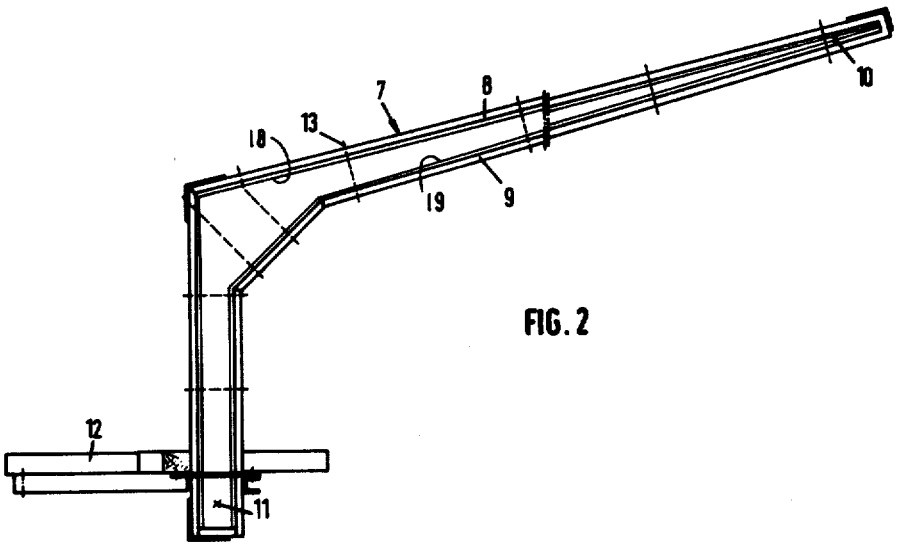
FIG. 2 is a top view of a mold by means of which the building construction elements can be manufactured.

In FIG. 2, a mold 7 is shown in top view in the position for introduction of the reaction mixture. The walls 8 and 9 of the mold are prevented from turning over by a supporting element 12 and clamping means 13 maintain the position of the walls relative to each other, especially during the foaming operations, during which considerable pressures may be produced Plate-shaped linings 18 and 19 are provided adjacent to the walls 8 and 9, respectively, of the mold.

By introducing the reaction mixture simultaneously into the mold approximately at points 10 and 11, there is obtained the effect that the weight per unit volume of the hardened foam care in the angular region of the construction element is about 5% higher than in the rest of the element, which is desirable for the above-mentioned reasons.

Naturally modifications may be made in the elements, as shown in the drawing, without departing from the scope of the invention. For instance it is possible to manufacture elements in which a profile is foamed directly in the proper place by means of a corresponding provision in the mold intended as attachment means for a roof gutter.

I claim:

1. A thermally insulated building construction element in the form of a half truss of plate truss shape comprising:

a polyurethane hard foam core having an outer arch side, an inner arch side, two lateral sides, and a weight per unit volume of at least about 30 kg/m$^3$ wherein the density and strength of the hard foam core in the angular region of the element are greater than the density and strength of the core adjacent to the ends of the element.

a bent plate outer lining bonded to the outer arch side of the hard foam core; and a bent plate inner lining bonded to the inner arch side of the hard foam core, the lateral sides of the building construction element being unlined.

2. A thermally insulated building construction element according to claim 1 wherein the average density of a major portion of the hard foam core is about 40 kg/m$^3$, and the average density of the hard foam core in the angular region of the element is approximately 2–3 kg/m$^3$ greater than said average density of the major portion of the core.

3. A thermally insulated building construction element according to claim 1 wherein at least a portion of the bent plate outer lining has a sheet piling profile.

4. A thermally insulated building construction element according to claim 1 wherein at least a portion of the bent plate outer lining has a corrugated profile.

5. A method of manufacturing a thermally insulated building construction element in the form of a half truss of plate truss shape, the method comprising constructing an open-top mold having a first upright bent wall corresponding to an outer arch side of half a plate truss lying on its side and a second upright bent wall, spaced apart from the first wall and corresponding to the inner arch side of half a plate truss lying on its side;

positioning a bent plate outer lining adjacent to the inner surface of the first wall of the mold;

positioning a bent plate inner lining adjacent to the inner surface of the second wall of the mold;

introducing a predetermined quantity of foaming plastic reaction mixture in stages into the open top of the mold; and simultaneously introducing the mixture in each stage into the mold adjacent each end thereof and flowing said mixture toward the central angled region from said ends allowing the mixture to foam in place to form an insulating core of synthetic hard foam of predetermined densities, said bonding core to the outer and inner bent plate linings whereby the resulting hard foam core will have a higher density and greater strength in the central angled region than in the ends 6. A method according to claim 5 wherein the step of introducing a predetermined quantity of foaming plastic reaction mixture into the mold comprises introducing the mixture in at least two stages and allowing the mixture introduced in each stage to foam before adding the mixture of the next stage.

7. A method according to claim 5 comprising covering the open top of the mold after introducing the foaming plastic reaction mixture to cause the mixture to foam under pressure.

* * * * *